US010968399B2

(12) United States Patent
Mayo et al.

(10) Patent No.: US 10,968,399 B2
(45) Date of Patent: Apr. 6, 2021

(54) ONLINE COKE REMOVAL IN A HEATER PASS

(71) Applicant: CITGO PETROLEUM CORPORATION, Houston, TX (US)

(72) Inventors: Brent Mayo, Westlake, LA (US); John Curry, Corpus Christi, TX (US); Darrell W. Gill, Westlake, LA (US)

(73) Assignee: CITGO PETROLEUM CORPORATION, Houston, TX (US)

( * ) Notice: Subject to any disclaimer, the term of this patent is extended or adjusted under 35 U.S.C. 154(b) by 373 days.

(21) Appl. No.: 15/946,623

(22) Filed: Apr. 5, 2018

(65) Prior Publication Data

US 2018/0291283 A1 Oct. 11, 2018

Related U.S. Application Data

(60) Provisional application No. 62/483,209, filed on Apr. 7, 2017.

(51) Int. Cl.
*C10G 9/16* (2006.01)
*C10G 51/06* (2006.01)
(Continued)

(52) U.S. Cl.
CPC ..... *C10G 9/16* (2013.01); *C10G 51/06* (2013.01); *C10G 9/206* (2013.01); *C10G 75/00* (2013.01)

(58) Field of Classification Search
CPC ..... C10G 9/16; C10G 51/06; C10G 9/206; C10G 75/00
See application file for complete search history.

(56) References Cited

U.S. PATENT DOCUMENTS 3,557,241 A * 1/1971 Kivlen et al. ..... C10G 9/16 585/648
4,917,787 A * 4/1990 Fukuhara ..... C10G 9/38 208/129

(Continued)

FOREIGN PATENT DOCUMENTS

CO 6970122 6/2014
CO 6970122 A1 6/2014

(Continued)

OTHER PUBLICATIONS

Jack Adams, Adams Project Managers, Inc., "Coker Furnace On-Line Spalling—Safe, Clean Proven, & Profitable," Paper presented at 2012 American Fuel & Petrochemical Manufacturers.

(Continued)

*Primary Examiner* — Randy Boyer
*Assistant Examiner* — Juan C Valencia
(74) *Attorney, Agent, or Firm* — McAfee & Taft

(57) ABSTRACT

This disclosure provides methods for decoking tubular passes of crude oil heaters and processed hydrocarbon heaters. The method permits continued operation of an associated crude oil processing unit or a processed hydrocarbon processing unit receiving crude oil or processed hydrocarbons from the heater during the decoking operation. The decoking operation utilizes dry steam to remove coke from passes within the crude oil heater or processed hydrocarbon heater and dry steam to maintain balanced operation of the crude oil processing unit or processed hydrocarbon processing unit.

29 Claims, 4 Drawing Sheets

(51) Int. Cl.
*C10G 9/20* (2006.01)
*C10G 75/00* (2006.01)

(56) References Cited

U.S. PATENT DOCUMENTS

| | | | | |
|---|---|---|---|---|
| 7,597,797 | B2 | 10/2009 | Gregory | |
| 7,635,023 | B2 | 12/2009 | Goldberg et al. | |
| 7,670,462 | B2 | 3/2010 | Gibson et al. | |
| 8,152,993 | B2 | 4/2012 | De Haan et al. | |
| 8,349,169 | B2 | 1/2013 | Osborne, III | |
| 9,127,211 | B2 | 9/2015 | Bhirud | |
| 2004/0173504 | A1 | 9/2004 | Klasnich et al. | |
| 2007/0158240 | A1* | 7/2007 | Gregory | F28G 9/00 208/131 |
| 2009/0020459 | A1* | 1/2009 | De Haan | C10G 9/16 208/48 R |
| 2014/0138282 | A1 | 5/2014 | Oyekan et al. | |
| 2015/0014120 | A1 | 1/2015 | Klein et al. | |
| 2015/0246379 | A1 | 9/2015 | Doerksen et al. | |
| 2015/0361360 | A1 | 12/2015 | Harris et al. | |
| 2015/0376512 | A1 | 12/2015 | Lourenco et al. | |
| 2016/0045841 | A1 | 2/2016 | Kaplan et al. | |
| 2016/0168479 | A1* | 6/2016 | Spicer | C10G 9/16 208/48 Q |

FOREIGN PATENT DOCUMENTS

| | | |
|---|---|---|
| EP | 0143486 | 6/1985 |
| EP | 0143486 A2 | 6/1985 |
| WO | 2015128036 | 9/2015 |
| WO | 2015128036 A1 | 9/2015 |

OTHER PUBLICATIONS

Olaf Deutschmann, http://www.itcp.kit.edu/deutschmann/download/book-chapters-not-listed-by-ISI/17 2012 CatalyticReformingLogisticFuels Deutschmann RSC, pdf., Catalytic Reforming of Logistic Fuels at High Temperatures, published 2012.

Ronald (Ron) F. Colwell, P.E., http://www.processengr.com/ppt presentations/oil refinery processes.pdf, "Oil Refinery Processes A Brief Overview," published 2009.

Ronald (Ron) F. Colwell, Oil Refinery Processes, 2009, p. 1-36.

Jack Adams, et al., Coker Furnace On-Line Spalling, 2012, p. 1-11.

Olaf Deutschmann, Catalytic Reforming of Logistic Fuels at High-Temperatures, 2012, p. 1-48.

* cited by examiner

ONLINE COKE REMOVAL IN A HEATER PASS

The present disclosure generally relates to heaters used in refineries for the processing of hydrocarbons, and more specifically to an online method for removing coke deposits within tubular passes of crude oil heaters.

BACKGROUND

Crude oil processing systems typically have a crude oil processing unit, such as an atmospheric or vacuum tower, and a crude oil heater which brings the temperature of the crude oil substantially up to operating temperature before entering the crude oil processing unit. Crude oil heaters have burners configured to increase the temperature of crude oil as it flows through passes within the crude oil heater. Passes are typically tubular, but it will be apparent to one skilled in the art that the passes may be any shape suitable for use in the art. Under typical operating conditions, coke, an insoluble organic deposit, forms over time on the internal walls of the passes resulting in fouling of the passes.

Coke deposits on the internal walls of the passes inhibit free flow of crude oil through the heater passes to the crude oil processing unit and reduce heat transfer through the walls of the passes. The reduction in heat transfer produces localized increases in tube metal temperatures of the passes within the heater which increases stress on the passes necessitating removal of the coke deposits, i.e., decoking. Decoking is typically understood as the conversion of coke to carbon dioxide, carbon monoxide, or hydrogen, and/or the physical removal of coke from within the passes in the heater. Coke deposit removal, or decoking, currently requires taking the heater and associated crude oil processing unit offline to permit decoking of the heater passes. These periodic shutdowns increase operating costs.

SUMMARY

The following detailed disclosure describes a method for removing coke deposits from within the passes of a heater in a crude oil processing system. As discussed above, the passes are located within a heater configured to pre-heat crude oil to a temperature suitable for processing within an atmospheric tower. The method provides the ability to continue operating the atmospheric tower during the coke removal process. The method comprises the steps of: during operation of said atmospheric tower receiving crude oil from said heater, reducing the flow rate of crude oil to said heater and said atmospheric tower; reducing the temperature on at least one pass within said heater; reducing the crude oil flow rate to said at least one pass; flowing dry steam through a steam line providing steam to said at least one pass; holding said dry steam on said at least one pass for a period of time sufficient to provide coke removal from interior walls of said pass; increasing the temperature on said at least one pass, such that coke deposit removal occurs; and raising the flow rate of crude oil to said heater and said crude oil processing unit.

In another embodiment, the method comprises the steps of: during operation of said crude oil processing unit receiving crude oil from said heater, reducing the flow rate of crude oil to said heater and said crude oil processing unit, such that at least one burner of said heater may operate at reduced firing rates; providing a steam line configured to provide steam to said at least one pass; reducing the temperature on said at least one pass such that the temperature of said at least one pass is maintained to preclude coke cracking; reducing the crude oil flow rate to said at least one pass; flowing dry steam through said steam line providing steam to said at least one pass; blocking an inlet block valve providing crude oil to a controller of the at least one pass; holding said dry steam on said at least one pass for a period of time sufficient to provide coke removal from interior walls of said pass; increasing the temperature on said at least one pass, such that coke deposit removal occurs; and raising said crude oil flow rate to said heater and said crude oil processing unit, such that said at least one burner of said heater may operate at conventional firing rates.

The following detailed disclosure also describes a method for removing coke deposits from within the passes of a heater within a hydrocarbon processing system. As discussed above, the passes are located within a heater configured to pre-heat hydrocarbons to a temperature suitable for processing within a vacuum tower. The method provides the ability to continue operating a vacuum tower during the coke removal process. The method comprises the steps of: during operation of said vacuum tower receiving hydrocarbons from said heater, reducing the flow rate of hydrocarbons to said heater and said vacuum tower; reducing the temperature on at least one pass within said heater; reducing the hydrocarbon flow rate to said at least one pass; flowing dry steam through a steam line providing steam to said at least one pass; holding said dry steam on said at least one pass for a period of time sufficient to provide coke removal from interior walls of said pass; increasing the temperature on said at least one pass, such that coke deposit removal occurs; and raising the hydrocarbon flow rate to said heater and said crude oil processing unit.

BRIEF DESCRIPTION OF THE DRAWINGS

The drawings included with this application illustrate certain aspects of the embodiments described herein. However, the drawings should not be viewed as exclusive embodiments. The subject matter disclosed herein is capable of considerable modifications, alterations, combinations, and equivalents in form and function, as will be evident to those skilled in the art with the benefit of this disclosure.

DETAILED DESCRIPTION

Figure 1:
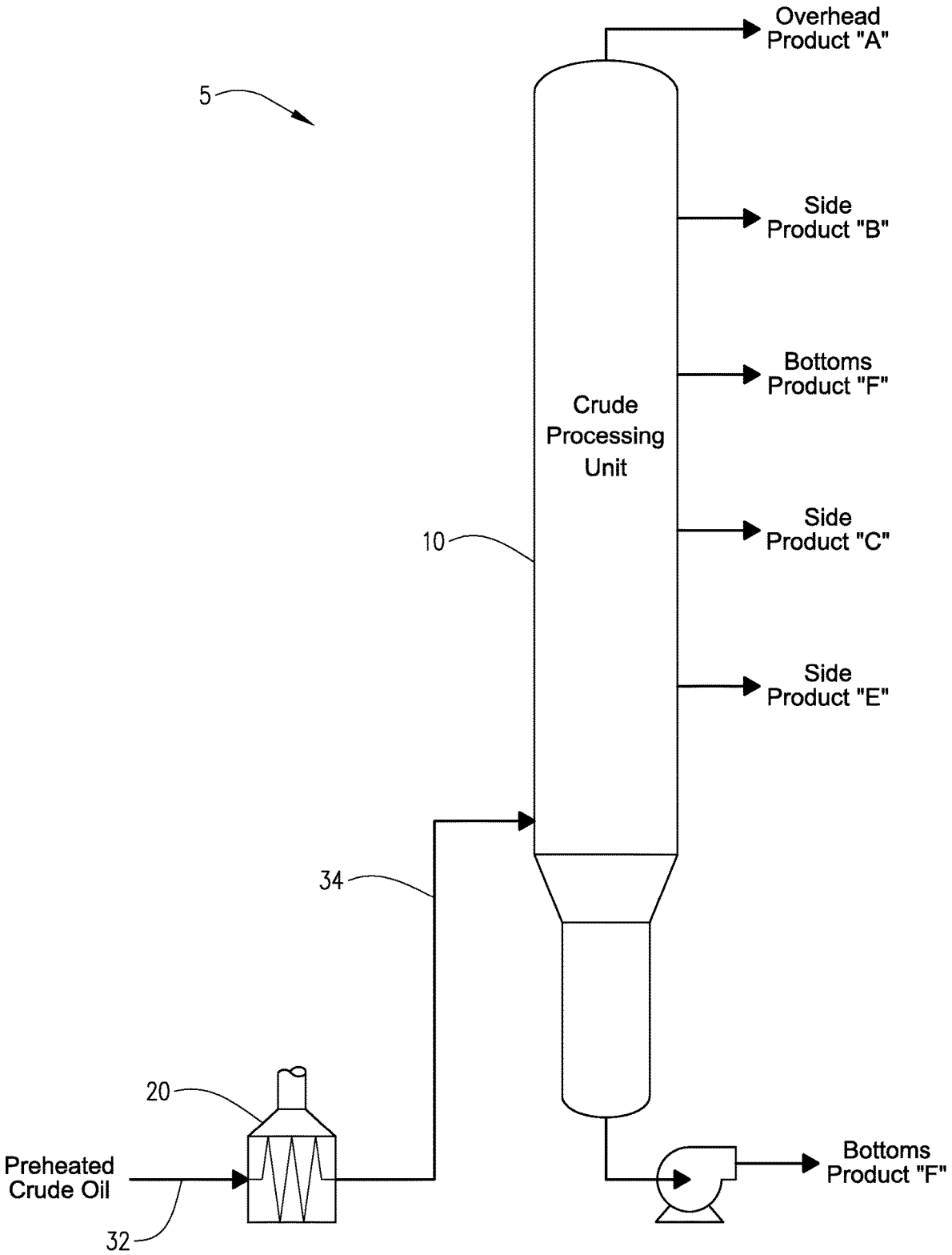
FIG. 1 schematically depicts a crude oil processing system including a crude oil heater and a crude oil processing unit.

With reference to FIG. 1, the methods disclosed herein are suitable for use in crude oil processing system 5 having a crude oil processing unit 10, i.e., an atmospheric tower 10 and a crude oil heater 20. Crude oil processing unit 10 is configured to accept a feed stream which includes steam. Crude oil heater 20 is suitable for increasing the temperature of crude oil to a desired operating temperature prior to the crude oil entering crude oil processing unit 10. As known to those skilled in the art, crude oil processing units and processed hydrocarbon processing units typically include a controller (not shown) for managing and monitoring unit operations. As known to those skilled in the art, atmospheric towers and vacuum towers commonly include overhead receiver water boots (not shown).

The following discussion describes methods for decoking the passes of a crude oil heater 20 positioned prior to an atmospheric tower 10. As used herein the term crude oil refers to a hydrocarbon stream which has been treated to render it suitable for processing in an atmospheric tower 10 but the crude oil has not been otherwise processed to produce hydrocarbon products.

The methods disclosed herein are equally applicable to decoking the passes of a hydrocarbon heater 20 positioned prior to a vacuum tower. As known to those skilled in the art, a vacuum tower typically receives the bottom products, i.e., processed hydrocarbons, of an atmospheric tower and further processes this hydrocarbon stream into useful hydrocarbon materials. In the process of decoking the passes of a hydrocarbon heater 20 positioned prior to a vacuum tower, the term "crude oil" as used in the following discussion can be replaced with "processed hydrocarbons" and the term "crude oil heater" can be replaced with "hydrocarbon heater." The steps of removing hydrocarbon from the passes of the hydrocarbon heater positioned prior to the vacuum tower will be the same as disclosed with reference to removal of coke from the passes of a crude oil heater positioned prior to an atmospheric tower. Therefore, for the sake of simplicity, the improved methods will be described only once in relation to the decoking of passes in a crude oil heater 20 positioned prior to a crude oil processing unit 10, i.e., an atmospheric tower 10. The lines and other identified components will be essentially the same in both systems.

With reference to FIG. 1, crude oil flows through a supply line 32 to crude oil heater 20. Crude oil heater 20 increases the temperature of the crude oil to the desired operating temperature. Subsequently, crude oil passes through line 34 to crude oil processing unit 10. Crude oil processing unit 10 processes or refines the crude oil into desired products.

Figure 2:
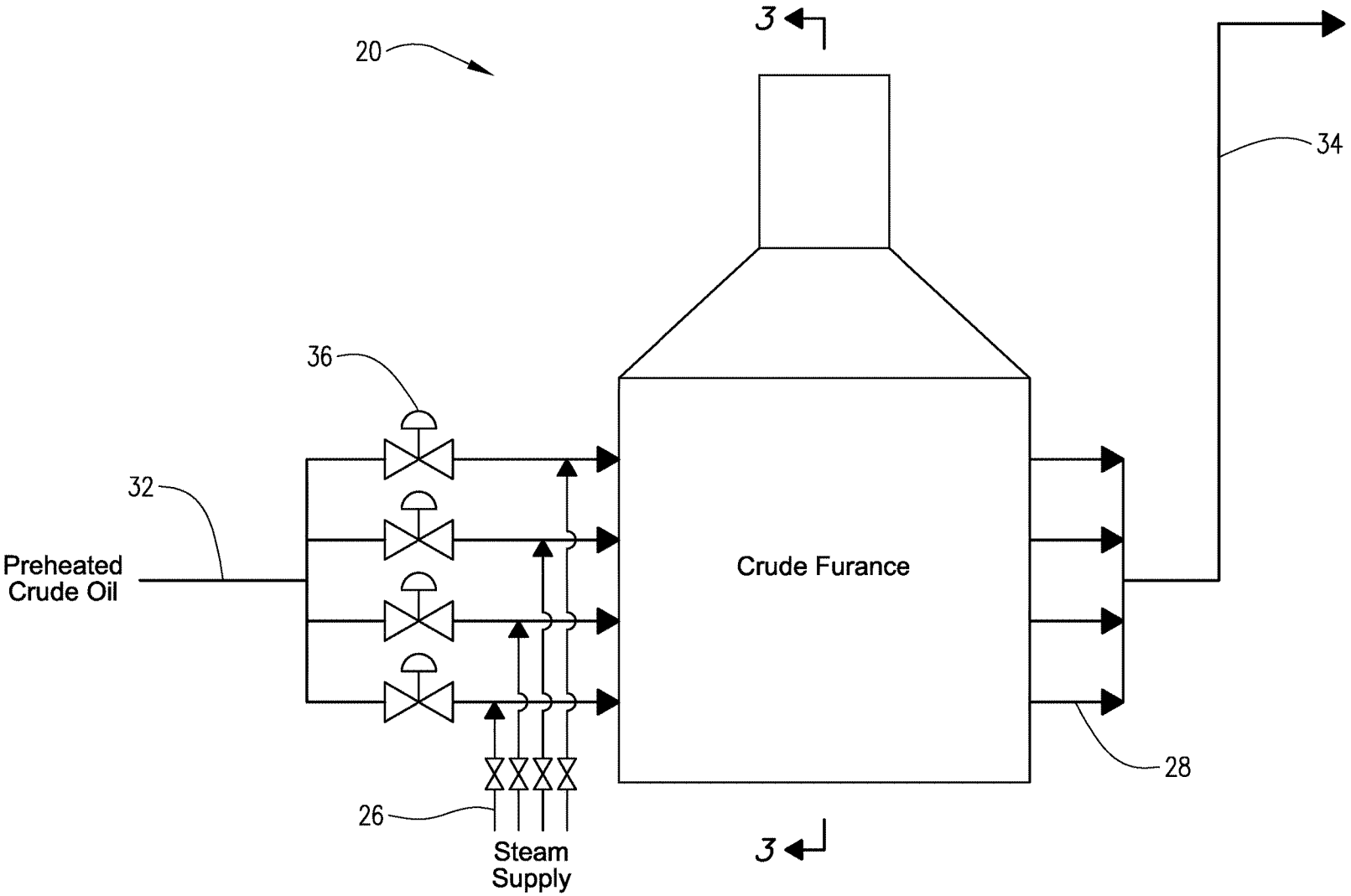
FIG. 2. depicts a side view of a crude oil heater suitable for increasing the temperature of crude oil prior to processing of crude oil in a downstream processing unit.
Figure 3:
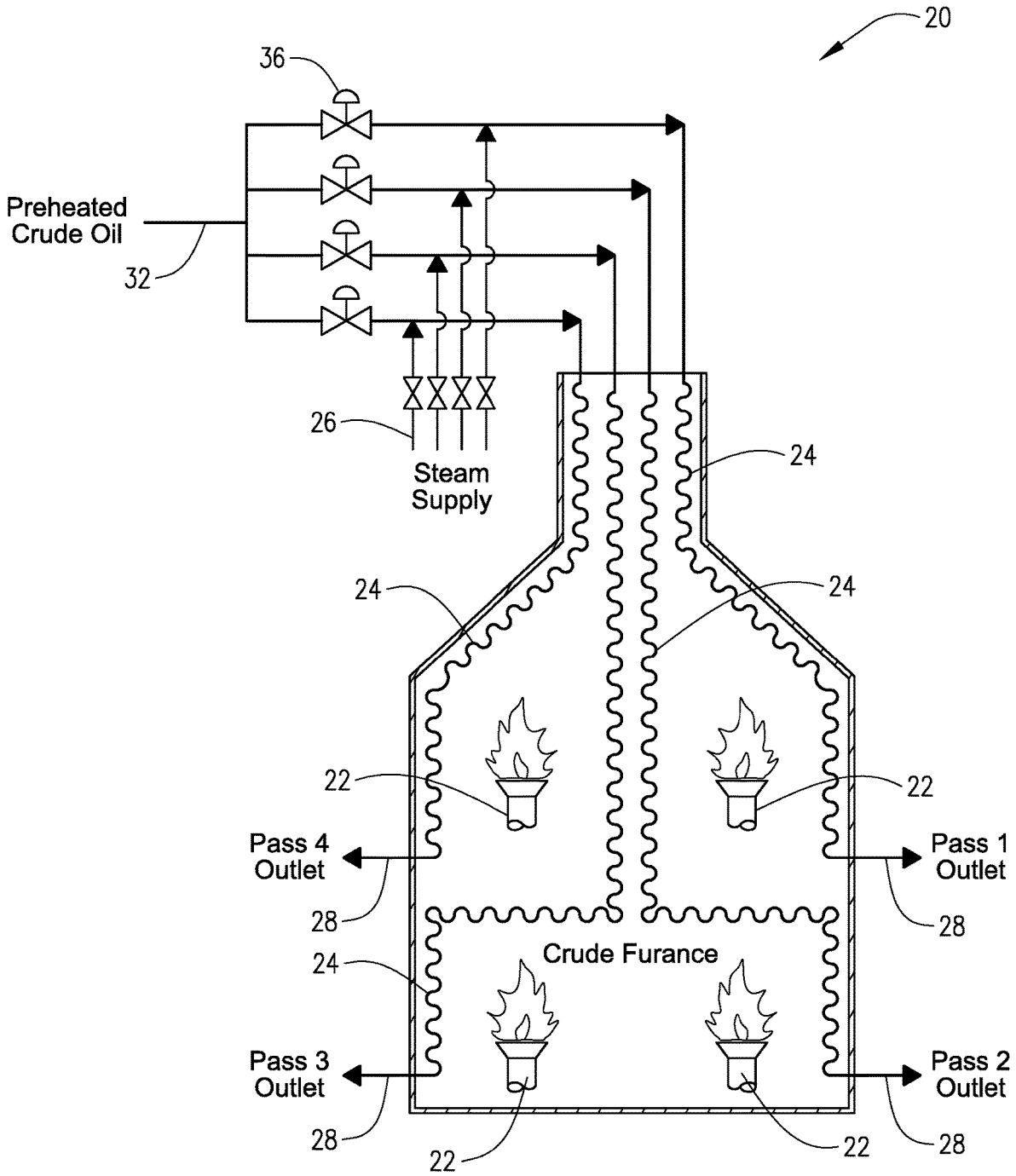
FIG. 3 is a section view of a crude oil heater taken along line 3 of FIG. 2.

With reference to FIGS. 2 and 3, a typical crude oil heater 20 comprises two or more burners 22 for increasing the temperature of crude oil to desired operating temperatures. Passes 24 receive crude oil from supply line 32 and convey crude oil through crude oil heater 20. Steam lines 26 provide steam to passes 24 for cleaning purposes and to maintain desired crude oil flow rates, i.e., charge rates, through passes 24. As depicted in FIG. 3, a plurality of passes 24 are associated with a single burner 22. Thus, each burner 22 provides heat to several passes 24 during operation of heater 20. Heated crude oil then flows through passes 24 and out pass outlets 28 to a crude oil outlet line 34. Crude oil outlet line 34 transports heated crude oil from pass outlets 28 to crude oil processing unit 10.

Under normal operating conditions, crude oil flows through passes 24 which convey heat from burners 22 to the flowing crude oil via heat transfer through the metal walls of passes 24. Thus, crude oil heater 20 increases the temperature of crude oil sufficiently to improve operation of crude oil processing unit 10. Optional steam may be provided via lines 26 to the passes 24 during normal crude oil heater 20 operation. One of ordinary skill in the art familiar with refinery operations will understand that a source of steam, known in the art as "coil steam," provides steam to processing units in emergency situations, e.g., when oil flow may suddenly stop. Additionally, steam may be provided to a processing unit, in this instance to passes 24, to provide a desired fluid flow rate or to increase the fluid flow rate through the processing unit, e.g. passes 24 of heater 20.

Under typical operating conditions, deposits known as "coke" eventually form in passes 24. Such deposits foul the internal walls of passes 24 reducing the flow of crude oil through passes 24 and disrupting the operation of the entire crude oil processing system 5. The resulting layer of coke reduces heat transfer through the metal wall frequently resulting in an increase in temperature of the metal surfaces, i.e., the tubeskin, of passes 24 due to reduced heat transfer, from the exterior to the interior of passes 24. The temperature increases in the tube metal temperature of the passes 24 can be uniform or localized to small areas depending on the operation of crude oil heater 20.

Prior to the method disclosed below, removal of deposited coke from the internal walls of passes 24 generally required periodic shutdown of crude oil processing system 5. The methods described below provide for cleaning of passes 24 while maintaining online operations of crude oil heater 20 and crude oil processing unit 10. In the following discussion of the online method for removing coke from passes 24 of heater 20, the crude oil processing unit 10 is described as an atmospheric tower 10. However, the following method will be applicable to other processing units using crude oil heaters 20, such as, but not limited to vacuum towers.

The following method will generally be initiated upon determination of undesirable coke deposits within passes 24 of heater 20 per conventional engineering practices for each heater 20, e.g., external temperatures of a pass 24 exceed accepted limitations for the heater 20 in question. Additional examples of how to determine the presence of excess coke deposits within passes 24 of heater 20 include, without limitation, a pressure drop caused by increased inlet pressures, increased firing rates, and excessive firebox temperatures.

The decoking process begins with continued operation of atmospheric tower 10; however, the charge rate of crude oil to crude oil heater 20 is adjusted such that at least one pass 24 operates at reduced crude oil charge rates. For example, in some embodiments, in which the heater 20 is being decoked for the first time, the charge rate of crude oil to crude oil heater 20 may be reduced by 40%-60% from normal operating conditions. In other embodiments, the charge rate may be reduced by 40%-45%, or from 165 mbpd down to between 90 mbpd and 100 mbpd. In additional embodiments, once the heater has been decoked by the disclosed process once, subsequent decoking operation may require a charge rate reduction of only 17%-33%. In general, the degree of charge rate reduction in each embodiment is selected to maintain stability within crude oil processing system 5.

In some instances, the charge rates on passes 24 not undergoing cleaning may be adjusted to compensate for the adjustments made on the pass 24 undergoing cleaning. As a result, the output of heated crude oil from heater 20 may be reduced. Following reduction of crude oil flow rate to the pass 24 to be cleaned, dry steam from steam line 26 begins to flow to the selected pass 24 to be cleaned. One of ordinary skill in the art will understand this reduction of crude oil flow rate to be the "minimum design flow rate" for that particular pass 24 undergoing cleaning. Prior to flowing steam through steam line 26, the operator will ensure that steam line 26 is dry. In addition to reducing the flow of crude oil to the pass 24 to be cleaned, burner operation of burner 22 associated with the pass 24 to be cleaned is reduced thereby lowering the temperature of the pass 24 to be cleaned.

In some embodiments, the transition from flowing oil to steam within pass 24 to be cleaned necessitates reduction of burner operation by 70%-90% of normal operation conditions. In other embodiments burner operation of burner 22 may be completely shut off during this transition. Once the transition from oil to steam has been completed, burner operation of burner 22 may be increased to operate at between 60%-90% of normal operating conditions. In additional embodiments, burner operation of burner 22 may be adjusted to reduced operating conditions at a percentage to achieve a reduction in the coil outlet temperature of the pass 24 to be cleaned from 725° F. down to 650° F.

During the reduction and removal of crude oil from the pass 24 to be cleaned, the burner 22 will continue to operate at a rate selected to maintain a temperature sufficient to prevent further formation of coke. The target temperature for the pass to be cleaned compensates for the lower heat capacity of steam, thereby protecting the walls of the pass to be cleaned from spikes in temperature which may cause any remaining residual oil (in the process of being removed by the flowed steam) to thermally "crack" forming gasses and carbon deposits. In some embodiments, it is desirable to have the temperature of the pass 24 to be cleaned below 1150° F. to prevent coke formation during the switch from oil to steam flowing through pass 24. In other embodiments, it is desirable to have the temperature of the pass 24 to be cleaned below 1000° F. In additional embodiments, it is desirable to drop the temperature of the pass 24 to be cleaned to approximately 800° F.

One skilled in the art will understand that there are varying types of crude oil heater 20. Accordingly, one of ordinary skill in the art will understand that the temperature to prevent coke formation during the switch from oil to steam flowing through the pass 24 to be cleaned will depend on the metallurgy characteristics of the particular passes 24 and the nature of the crude oil. The target tubeskin temperature on the at least one pass 24 to be cleaned is not a critical temperature. The tubeskin temperature on the at least one pass 24 undergoing cleaning need only be reduced below the normal operating temperature of the specific crude oil heater 20. Thus, the method disclosed herein prepares only a fraction of passes 24 of crude oil heater 20 for coke deposit removal. As a result, crude oil heater 20, atmospheric tower 10, and the overall crude oil processing system 5 do not have to be taken offline or shut down to achieve coke deposit removal. One of ordinary skill in the art will understand that the initial reduction of temperature and crude oil charge rate may temporarily affect operation and products of atmospheric tower 10. However, one of ordinary skill in the art will further understand this minimal effect is less cumbersome than shutting down heater 20 and atmospheric tower 10 during the decoking process.

Reducing the temperature on the at least one pass 24 may be achieved by any one process or a combination of processes known by those skilled in the art. For example, in one embodiment, the output, i.e., firing rate, of burner 22 associated with the at least one pass 24 undergoing cleaning may be reduced. In some embodiments, the firing rate of burner 22 may be reduced by 40% to 60%. In other embodiments, the firing rate of burner 22 may be reduced by 17% to 45%. Alternatively, one may completely shut off burner 22 associated with the at least one pass 24 undergoing cleaning. In another embodiment, the temperature of the passes adjacent to the at least one pass 24 may be reduced by any of the previously mentioned methods. One of ordinary skill in the art will recognize and understand that a combination of the above methods may be used to sufficiently reduce the temperature on the at least one pass 24.

At this point in the process, all the passes 24 sharing a common burner 22 with pass 24 undergoing cleaning will be operating at a reduced temperature. The remaining unaffected passes 24 will continue to operate at normal crude oil flow rates and temperatures. Thus, the passes 24 not undergoing the coke deposit removal process will continue to supply crude oil at a temperature required by crude oil processing unit 10 without interruption.

Following preparation of pass 24 undergoing coke deposit removal, steam line 26 will provide dry steam, as that term is known to those skilled in the art, to the at least one pass 24 undergoing cleaning. The feed rate of the dry steam should be monitored and slowly increased to ensure that the dry steam flow rate provides a pressure greater than the operating pressure of pass 24 undergoing cleaning to ensure the crude oil flow does not re-enter pass 24 undergoing cleaning. Typically, a dry stream supply valve, not shown, is opened slowly at a uniform rate over a period selected to minimize the likelihood of pressure surges or upsets to the crude oil flow. Time for opening the supply valve is typically one minute or less. Inlet pressure of pass 24 undergoing cleaning must be monitored closely as steam flow rate increases to ensure the dry steam maintains a pressure greater than the inlet pressure of pass 24.

Upon completion of the steam injection step and reduction of crude oil from the at least one pass 24 undergoing cleaning, crude oil flow to this pass 24 is stopped by actuating the inlet block valve 36. The remaining passes 24 remain online with crude oil flowing through crude oil heater 20 to atmospheric tower 10. The dry steam continues to flow through steam line 26 and the pass 24 undergoing cleaning for a sufficient amount of time at reduced temperatures, i.e., reduced burner 22 firing rates, to ensure removal of substantially all crude oil. Preferably, dry steam flows through steam line 26 into the pass 24 undergoing cleaning for a predetermined period of time calculated to remove all crude oil from pass 24 undergoing cleaning. In some embodiments, the period of time necessary to remove all crude oil from pass 24 undergoing cleaning may be between 20 and 30 minutes. In other embodiments, it may be between 5 and 15 minutes. In additional embodiments, it may be between 5 and 10 minutes. The calculated time for crude oil removal can be based on the time required for the tubeskin temperatures of the pass 24 undergoing cleaning to stabilize. Stabilization of the tubeskin temperature indicates the removal of all residual amounts of oil and reflects the presence of only steam within pass 24 undergoing cleaning. Prior to stabilization, tubeskin temperature will be elevated. As the pass is prepared to switch from crude oil to steam the temperature will drop to less than 1000° F. Once steam flow has been established, the temperature will stabilize near the operating temperature of the burner in operation for the pass 24 undergoing decoking operations. Thus, temperature stabilization is the "trigger" or "validation" point for moving on to the next step in the process.

Figure 4:
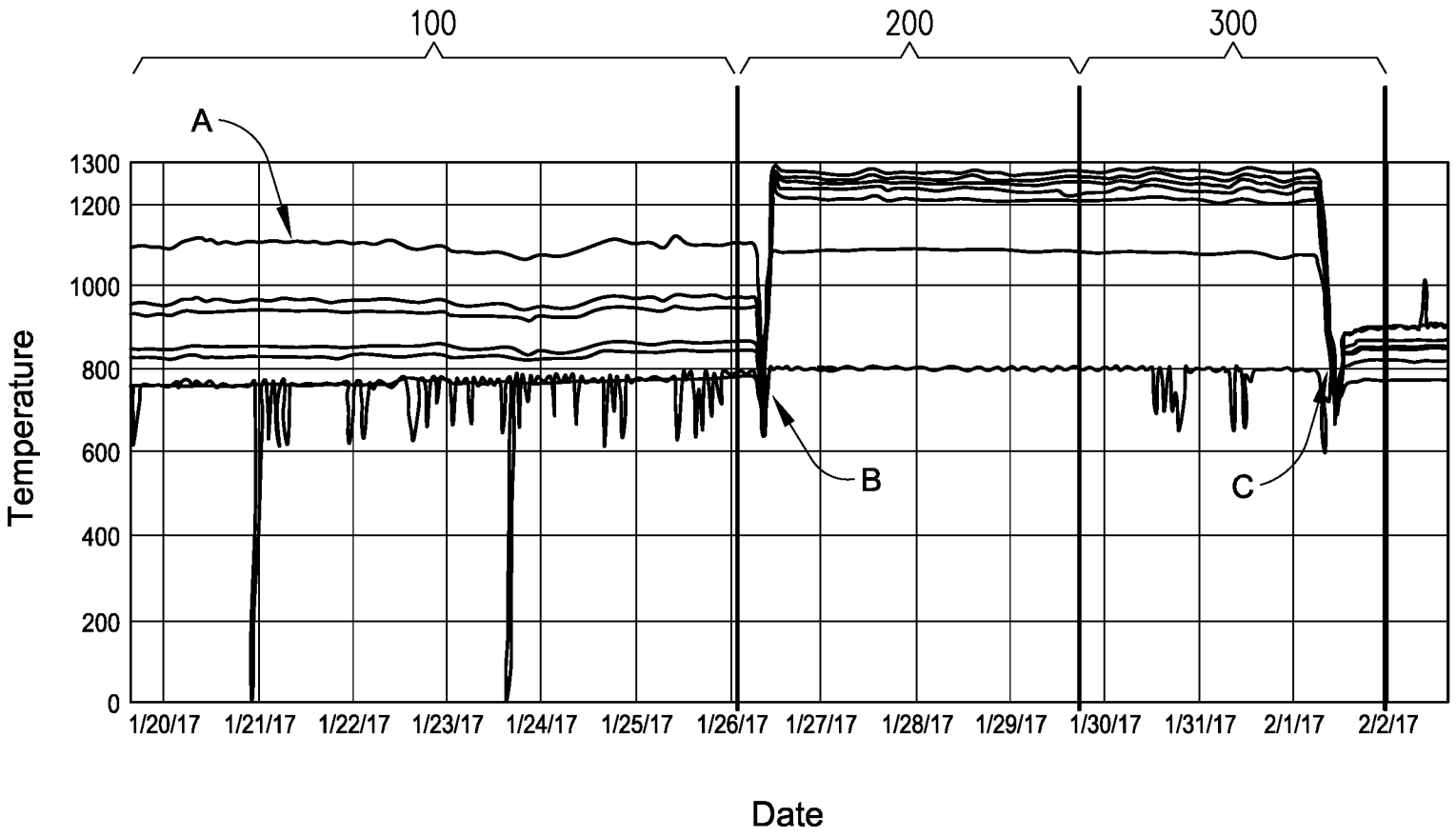
FIG. 4 is a table depicting temperatures in a pass before, during and after decoking.

With specific reference to FIG. 4, one of ordinary skill in the art will be able to readily identify the specific condition requirements indicative of complete crude oil removal from pass 24 undergoing cleaning. For example, the temperature of outlet line 34 can be continuously monitored. The initial temperature A during the portion 100 of FIG. 4 corresponds to the temperature of only crude oil flowing through pass 24. Once the presence of crude oil is reduced and steam predominantly begins flowing through pass 24 and into outlet line 34, a dramatic decrease and subsequent increase in the temperature will follow, shown by B in FIG. 4. The temperature increase reflects the presence of steam and the reduction of crude oil in pass 24 undergoing cleaning. Stabilization of the temperature at outlet line 34, shown by the portion 200 of FIG. 4, is indicative to one of ordinary skill in the art that only steam is passing through outlet line 34 reflecting complete removal of liquid crude oil from pass 24 undergoing cleaning.

The continued flow of steam through pass 24 undergoing cleaning removes coke from the interior wall of the pass 24. As described below, steam continues to flow through pass 24 undergoing cleaning until completion of the decoking process. Upon re-establishment of the desired crude oil flow rate after cleaning of the pass 24, steam flow to the pass 24 is cut off.

Upon stabilization of the tubeskin temperature of pass 24 undergoing cleaning, thereby reflecting the presence of only steam within the pass, operation of burner(s) 22 associated with pass 24 undergoing cleaning is increased to aid in removal of coke from the interior wall of pass 24 undergoing cleaning. For example, operation of burner 22 will be increased sufficiently to raise the tubeskin temperature of pass 24 undergoing cleaning to between 1100° F. to 1300° F. In other embodiments, burner 22 will be increased sufficiently to raise the tubeskin temperature of pass 24 undergoing cleaning to a temperature of about 1200° F., more preferably the temperature may be increased to 1250° F. The maximum tubeskin temperature to be achieved during this step will preferably be determined by a qualified metallurgist familiar with the heater 20 materials. One of ordinary skill in the art will understand heater 20 materials to include, without limitation, the metal composition of the tubes or passes, the hangars, the refractory, and the bridgewall. Conservatively, by way of example, the increase in temperature will occur in increments of about 50° F. per hour to ensure a smooth temperature transition. However, one of ordinary skill will understand that coke removal will occur in reduced time at higher temperatures. The maximum temperature for coke removal will depend on the tubeskin metallurgy of pass 24 undergoing cleaning.

Increasing the temperature on pass 24 undergoing cleaning may be achieved by any one or a combination of processes known by those skilled in the art. For example, in one embodiment, burner 22 associated with pass 24 undergoing cleaning may resume conventional operation firing rates. In another embodiment, the temperature of the passes adjacent to the at least one pass 24 may be increased by any of the previously mentioned methods. One of ordinary skill in the art will recognize and understand that a combination of the above methods may be used to sufficiently increase the temperature on the at least one pass 24.

Confirming that coke deposits have sufficiently been removed from within the at least one pass 24 may be achieved by any number of ways known by those skilled in the art. For example, infrared analysis may be used to see the inner walls of the at least one pass 24.

The timing required for adequate removal of coke depends on the coke properties. Coke deposits that have been in place for 5 years will take longer to remove than coke that is less than 1 year old as older coke will be less porous than freshly formed coke. Thus, the older the coke deposit, the greater period required for reaction and removal. Accordingly, coke removal may require from hours to days. For example, the decoking step may require only 24 hours if performed on an annual basis. In general, the time period required will likely be determined by measuring the effectiveness of the coke removal (using infrared scans) after the pass 24 has been placed back in crude oil service. To provide a basis for this determination, tubeskin temperature of pass 24 should be measured prior to coke removal, and then again after the decoking process. If the tubeskin temperature of pass 24 is running at normal operating temperatures, when compared to a known clean pass of the same metallurgy, then decoking is complete. If the tubeskin temperature of pass 24 is running higher than normal operating temperatures, the decoking step must be repeated. Additionally, this information can be used to improve the efficiency of the coke removal process for the remaining passes 24.

During the decoking step of the present disclosure, atmospheric tower 10 remains online. Atmospheric tower 10 remains online by proportionally adjusting the bottom stripping steam to atmospheric tower 10. The bottom stripping steam to atmospheric tower 10 is proportionally adjusted based on the amount of dry steam flowed through steam line 26 to pass 24 undergoing cleaning. This ensures the volume of overhead receiver water remains constant prior to decoking of pass 24, during decoking of pass 24, and during normal operations of crude oil heater 20. The flow rate of crude oil through the crude processing system is maintained throughout the decoking process allowing atmospheric tower 10 to remain online and process products.

FIG. 4 provides a depiction of tubeskin temperatures of passes 24 during a decoking process during a test decoking of a heater 20. Phase 100 shows the tubeskin temperatures of passes 24 while the heater 20 is operating at normal operating conditions. Phase 100 of FIG. 4 depicts an elevated tubeskin temperature reflecting the presence of additional coke deposits that formed during a shutdown of a crude oil processing system 5 from an unscheduled outage. Phase 200 depicts the further increase in tubeskin temperatures of passes 24 to a desired temperature for coke removal. The temperature of phase 200 is maintained by the processes described herein. Passes 24 were maintained at the elevated temperatures by manipulating the number of burners 22 in operation within heater 20. Tubeskin temperature B shows the temperature changes on the passes 24 during the transition of adding the steam and removing the oil from pass 24 being cleaned. The first step of reducing the temperature on the passes 24 is in preparation for removing the oil from the pass being cleaned. The second step of increasing the temperature on the passes 24 begins once only steam is flowing through the passes 24 and decoking has started. Tubeskin temperature C shows the tubeskin temperatures of passes 24 during the transition from steam back to oil within the pass 24 that underwent cleaning. The first step in preparing to return oil flow to pass 24 is an initial temperature reduction. The second step is removal of steam from pass 24 which has been cleaned and an increase in burner operation to normal operating conditions once only oil is flowing through the cleaned pass 24. Phase 300 shows the tubeskin temperatures stabilizing back to normal operating conditions, indicating the removal of coke from the inner diameter of the pass 24. The lower temperatures of phase 300 when compared to phase 100 indicate coke removal from passes 24. Thus, the temperatures of the passes 24 in phase 300 have returned to the normal, desired operating temperatures rather than undesired, elevated temperatures of phase 100. Therefore, the temperature of phase 300 can be used as a baseline for monitoring the development of coke deposits in passes 24.

Other embodiments of the present invention will be apparent to one skilled in the art. As such, the foregoing description merely enables and describes the general uses and methods of the present invention. Accordingly, the following claims define the true scope of the present invention.

What is claimed is:

1. A method for removing coke deposits from within passes of a crude oil heater, said passes located within a heater configured to provide heated crude oil to a crude oil processing unit, said crude oil processing unit configured to accept a feed stream which includes steam, comprising:

during operation of said crude oil processing unit receiving heated crude oil from said heater, reducing the flow rate of crude oil to said heater and said crude oil processing unit;

reducing the temperature on at least one pass within said heater;

after reducing the temperature on said at least one pass, reducing the crude oil flow rate to said at least one pass;

flowing dry steam through a steam line providing steam to said at least one pass;

holding said dry steam on said at least one pass for a period of time sufficient to provide coke removal from interior walls of said pass;

increasing the temperature on said at least one pass, such that coke deposit removal occurs; and raising the flow rate of crude oil to said heater and said crude oil processing unit.

2. The method of claim 1, wherein said crude oil processing unit is an atmospheric tower.

3. The method of claim 1, further comprising the step of drying out said steam line.

4. The method of claim 1, wherein the step of reducing the temperature on said at least one pass is achieved by any one of or a combination of the following processes: reducing the firing pressure of at least one burner of said heater, reducing the firing rate of at least one burner of said heater, shutting off at least one burner of said heater, and reducing the temperature of the passes adjacent to said at least one pass.

5. The method of claim 1, wherein the step of reducing the temperature on said at least one pass is achieved by reducing the firing rate of at least one burner of said heater.

6. The method of claim 5, wherein the firing rate of said at least one burner of said heater is reduced by 40% to 60%.

7. The method of claim 5, wherein the firing rate of said at least one burner of said heater is reduced by 17% to 45%.

8. The method of claim 1, wherein the temperature on said at least one pass within said heater is reduced such that the temperature of said at least one pass is maintained at a sufficient temperature to preclude coke cracking.

9. The method of claim 1, wherein the step of reducing the temperature on said at least one pass results in the temperature on the at least one pass being less than 1150° F.

10. The method of claim 1, wherein the step of reducing the temperature on said at least one pass results in the temperature on the at least one pass being between 800° F. and 1150° F.

11. The method of claim 1, further comprising the step of actuating an inlet block valve providing crude oil to said at least one pass to preclude flow of crude oil through said at least one pass.

12. The method of claim 1, wherein the step of holding said dry steam on said at least one pass continues for between 20 and 30 minutes.

13. The method of claim 1, wherein the step of holding said dry steam on said at least one pass continues for between 5 and 15 minutes.

14. The method of claim 1, further comprising the step of adjusting a bottom stripping steam to said crude oil processing unit proportionally such that a constant level in overhead receiver water is maintained in an overhead receiving water boot.

15. The method of claim 1, wherein the step of increasing the temperature on said at least one pass is achieved by any one of or a combination of the following processes: increasing the firing pressure of said at least one burner of said heater, increasing the firing rate of said at least one burner of said heater, turning on said at least one burner of said heater, and increasing the temperature of the passes adjacent to said at least one pass.

16. The method of claim 1, wherein the step of increasing the temperature on said at least one pass increases the temperature to between 1100° F. and 1300° F. such that coke deposit removal occurs.

17. A method for removing coke deposits from within passes of a crude oil heater, said passes located within a heater configured to provide heated crude oil to a crude oil processing unit, said crude oil processing unit configured to accept a feed stream which includes steam, comprising:

during operation of said crude oil processing unit receiving heated crude oil from said heater, reducing the flow rate of crude oil to said heater and said crude oil processing unit, such that at least one burner of said heater may operate at reduced firing rates;

providing a steam line configured to provide steam to said at least one pass;

reducing the temperature on said at least one pass such that the temperature of said at least one pass is maintained to preclude coke cracking;

reducing the crude oil flow rate to said at least one pass;

flowing dry steam through said steam line providing steam to said at least one pass;

actuating an inlet block valve providing crude oil to the at least one pass thereby precluding flow of crude oil to the at least one pass;

holding said dry steam on said at least one pass for a period of time sufficient to provide coke removal from interior walls of said pass;

increasing the temperature on said at least one pass, such that coke deposit removal occurs; and raising said crude oil flow rate to said heater and said crude oil processing unit, such that said at least one burner of said heater may operate at conventional firing rates.

18. A method for removing coke deposits from within passes of a processed hydrocarbon heater, said passes located within a heater configured to provide heated hydrocarbons to a vacuum tower, said vacuum tower configured to accept a feed stream which includes steam, comprising:

during operation of said vacuum tower receiving heated hydrocarbons from said heater, reducing the flow rate of hydrocarbons to said heater and said vacuum tower;

reducing the temperature on at least one pass within said heater;

reducing the flow rate to said at least one pass;

flowing dry steam through a steam line providing steam to said at least one pass;

holding said dry steam on said at least one pass for a period of time sufficient to provide coke removal from interior walls of said pass;

increasing the temperature on said at least one pass, such that coke deposit removal occurs; and raising the flow rate of hydrocarbons to said heater and said vacuum tower.

19. The method of claim 18, further comprising the step of drying out said steam line.

20. The method of claim 18, wherein the step of reducing the temperature on said at least one pass is achieved by any one of or a combination of the following processes: reducing the firing pressure of at least one burner of said heater, reducing the firing rate of at least one burner of said heater, shutting off at least one burner of said heater, and reducing the temperature of the passes adjacent to said at least one pass.

21. The method of claim 18, wherein the step of reducing the temperature on said at least one pass is achieved by reducing the firing rate of at least one burner of said heater.

22. The method of claim 21, wherein the firing rate of said at least one burner of said heater is reduced by 40% to 60%.

23. The method of claim 21, wherein the firing rate of said at least one burner of said heater is reduced by 17% to 45%.

24. The method of claim 18, wherein the step of reducing the temperature on said at least one pass results in the temperature on the at least one pass being between 800° F. and 1150° F.

25. The method of claim 18, wherein the step of holding said dry steam on said at least one pass continues for between 20 and 30 minutes.

26. The method of claim 18, wherein the step of holding said dry steam on said at least one pass continues for between 5 and 15 minutes.

27. The method of claim 18, further comprising the step of adjusting a bottom stripping steam to said vacuum tower proportionally such that a constant level of overhead receiver water is maintained in an overhead receiving water boot.

28. The method of claim 18, wherein the step of increasing the temperature on said at least one pass is achieved by any one of or a combination of the following processes: increasing the firing pressure of said at least one burner of said heater, increasing the firing rate of said at least one burner of said heater, turning on said at least one burner of said heater, and increasing the temperature of the passes adjacent to said at least one pass.

29. The method of claim 18, wherein the step of increasing the temperature on said at least one pass increases the temperature to between 1100° F. and 1300° F. such that coke deposit removal occurs.

* * * * *